US006366678B1

(12) United States Patent
Madaffari et al.

(10) Patent No.: US 6,366,678 B1
(45) Date of Patent: Apr. 2, 2002

(54) MICROPHONE ASSEMBLY FOR HEARING AID WITH JFET FLIP-CHIP BUFFER

(75) Inventors: Peter Madaffari, Camden, ME (US); Walter P. Sjursen, Washington Crossing, PA (US); Christopher Poux, Trenton; Richard Moroney, Princeton, both of NJ (US); Ponnusamy Palanisamy, Lansdale, PA (US)

(73) Assignees: Sarnoff Corporation, Princeton, NJ (US); Tibbetts Industries, Inc., Camden, ME (US)

( * ) Notice: Subject to any disclaimer, the term of this patent is extended or adjusted under 35 U.S.C. 154(b) by 0 days.

(21) Appl. No.: 09/478,389

(22) Filed: Jan. 6, 2000

Related U.S. Application Data

(60) Provisional application No. 60/115,011, filed on Jan. 7, 1999, provisional application No. 60/134,896, filed on May 19, 1999, and provisional application No. 60/157,872, filed on Oct. 6, 1999.

(51) Int. Cl.[7] ..... H04R 25/00
(52) U.S. Cl. ..... 381/324; 381/175
(58) Field of Search ..... 381/174, 175, 381/191, 173, 368, 324; 367/170; 257/686, 777, 778, 783, 784

(56) References Cited

U.S. PATENT DOCUMENTS

| | | | | | |
|---|---|---|---|---|---|
| 4,456,796 | A | * | 6/1984 | Nakagawa et al. | 381/191 |
| 4,764,690 | A | | 8/1988 | Murphy et al. | 307/400 |
| 4,922,471 | A | | 5/1990 | Kuehnel | 367/181 |
| 5,255,246 | A | | 10/1993 | van Halteren | 367/170 |
| 5,684,324 | A | | 11/1997 | Bernstein | 257/415 |
| 5,809,158 | A | | 9/1998 | van Halteren et al. | 381/200 |
| 5,856,914 | A | | 1/1999 | O'Boyle | 361/761 |
| 5,920,090 | A | | 7/1999 | Stenberg | 257/252 |
| 6,088,463 | A | * | 7/2000 | Rombach et al. | 381/174 |
| 6,133,626 | A | * | 10/2000 | Hawke et al. | 257/686 |
| 6,178,249 | B1 | * | 1/2001 | Hietanen et al. | 381/173 |

FOREIGN PATENT DOCUMENTS

| | | |
|---|---|---|
| EP | 802 700 | 10/1997 |
| EP | 800 331 | 1/1998 |
| WO | WO 97/01258 | 1/1997 |

* cited by examiner

*Primary Examiner*—Duc Nguyen
*Assistant Examiner*—Suhan Ni
(74) *Attorney, Agent, or Firm*—Hamilton, Brook, Smith & Reynolds, P.C.

(57) ABSTRACT

A hearing aid microphone module housing all the electronic components needed for a functional hearing aid other than the battery and receiver is described which uses flip-chip technology to couple a JFET buffer to the components. The buffer is disposed on a PCB which defines a back volume of the housing.

9 Claims, 3 Drawing Sheets

MICROPHONE ASSEMBLY FOR HEARING AID WITH JFET FLIP-CHIP BUFFER

RELATED APPLICATION

This application is related to U.S. Provisional Application Ser. No. 60/115,011, filed on Jan. 7, 1999, U.S. Provisional Application Ser. No. 60/134,896, filed May 19, 1999 and U.S. Provisional Application Ser. No. 60/157,872, filed Oct. 6, 1999, and U.S. Patent Application entitled "Hearing Aid with Large Diaphragm Microphone Element Including a Printed Circuit Board", filed this date, the contents of each of which are incorporated herein by reference.

BACKGROUND OF THE INVENTION

The performance of a hearing aid depends, among other things, upon the design of the microphone assembly which includes the microphone transducer, sound port, and a housing containing the signal processing electronics. The microphone transducer is typically a variable capacitor or electret type microphone formed of a charged diaphragm forming one plate of the capacitor and a backplate forming the other terminal. Sound impinging on the diaphragm varies the capacitance and produces a voltage signal proportional to the sound waves which is picked off the backplate and coupled to signal processing circuits where it is amplified in an amplifier and electrically processed to, inter alia, reduce noise content. The processed signal is then coupled to a receiver and converted back to sound waves to aid the user.

Conventional in the ear (ITE) or in the canal (ITC), hearing aids must of necessity be of relatively small size. Therefore, such aids have been fabricated with accessible replaceable batteries which are accessed via a faceplate door on the hearing aid enclosure. These size and battery requirements cause the microphone assembly and also the diaphragm to be relatively small in size in relation to the size of the hearing aid faceplate. The small diaphragm size lowers the quality of the transducer function.

An electret microphone for hearing aids typically uses a Junction Field Effect Transistor (JFET) buffer to convert the voltage signal from the high impedance transducer source to a low impedance source. This impedance conversion typically requires a difficult connection to be made to a high quality and hence, expensive substrate on a Printed Circuit Board (PCB) containing the signal processing components, so as to avoid compromising the input impedance of an amplifier on the substrate.

SUMMARY OF THE INVENTION

This invention is directed to a microphone assembly for a hearing aid comprising a metal housing with a front wall with sound openings and a side wall extending longitudinally away from the front wall. Within the housing is an electret type microphone or transducer having a diaphragm electrode and a backplate electrode. External sound entering through the openings are converted into an electrical voltage signal which is coupled from the backplate to a Junction Field Effect Transistor (JFET) buffer device. The buffered signal is then coupled to an amplifier and signal processing components within the housing.

In one embodiment of the invention, the JFET device is a flip-chip component with four active terminals. Drain, source, bias and gate terminals are provided. The gate terminal is located on a side of the flip-chip proximal to and adjacent the backplate. The other terminals are connected to respective traces on a PCB. All the signal processing circuits needed to provide a functional hearing aid are contained on the PCB. The PCB also provides an acoustic seal to a back volume of the microphone and contains an electromagnetic interference (EMI) ground shield in the form of a ground plane of conductive material extending across the side wall of the housing.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same or similar parts throughout the different views. The drawings are not necessarily to scale, emphasis instead being placed upon illustrating the principles of the invention.

A more detailed understanding of the invention may be had from the following description of preferred embodiments, given by way of example and to be understood in conjunction with the accompanying drawing, wherein.

DETAILED DESCRIPTION OF THE EMBODIMENTS

In the apparatus and method of the invention, an electret microphone for hearing aids uses a JFET buffer to convert the signal from the backplate, i.e., a high impedance source (the microphone) to a low impedance source. This impedance conversion results in a higher level loaded output signal level to the hearing aid amplifier than would be produced from the condenser microphone element itself without a buffer. A JFET gate contact to the backplate of the microphone's condenser must somehow be made. A direct connection from a small pad on the JFET to the microphone backplate is difficult to do and the use of an intermediate wire bond pad requires that the pad be mounted on ceramic, which complicates assembly. If the JFET gate connection is on the PCB substrate, the substrate must have high resistivity to not compromise the input impedance of the amplifier. A ceramic (alumina) substrate has such properties. The electrical connections for the JFET can be wire bonded from the microphone element onto a ceramic substrate. However, wire bonds are normally formed with a loop from pads on the JFET to extra bonding pads on the ceramic substrate, a practice that requires extra space vertically and horizontally and produces stray capacitance to ground and other circuit nodes which reduce sensitivity and introduce noise. Other disadvantages of a ceramic substrate itself are that it is relatively costly for use in a disposable hearing aid application. It also has a high dielectric constant which makes stray capacitance even higher.

In accordance with the embodiment shown in FIGS. 1–4, flip chip technology is used to minimize the physical size and lead lengths required to connect die bond pads of a JFET 10 to reduce the lead length between the electret microphone backplate 12 and the JFET. The result is a lower noise and higher sensitivity connection than could be made by longer paths formed by conventional wiring. The JFET backside gate 14 is connected to the backplate 12 by conductive epoxy 20. This keeps the connection to the JFET off the PCB substrate 18 so that a lower cost substrate such as a glass-epoxy printed circuit board (e.g., FR4) may be used. Since the JFET gate 14 does not contact the substrate 18 and then connect to the microphone backplate 12 (rather the JFET is connected to the backplate directly), the stray capacitance should be lower and, hence, sensitivity should be higher.

Figure 1:
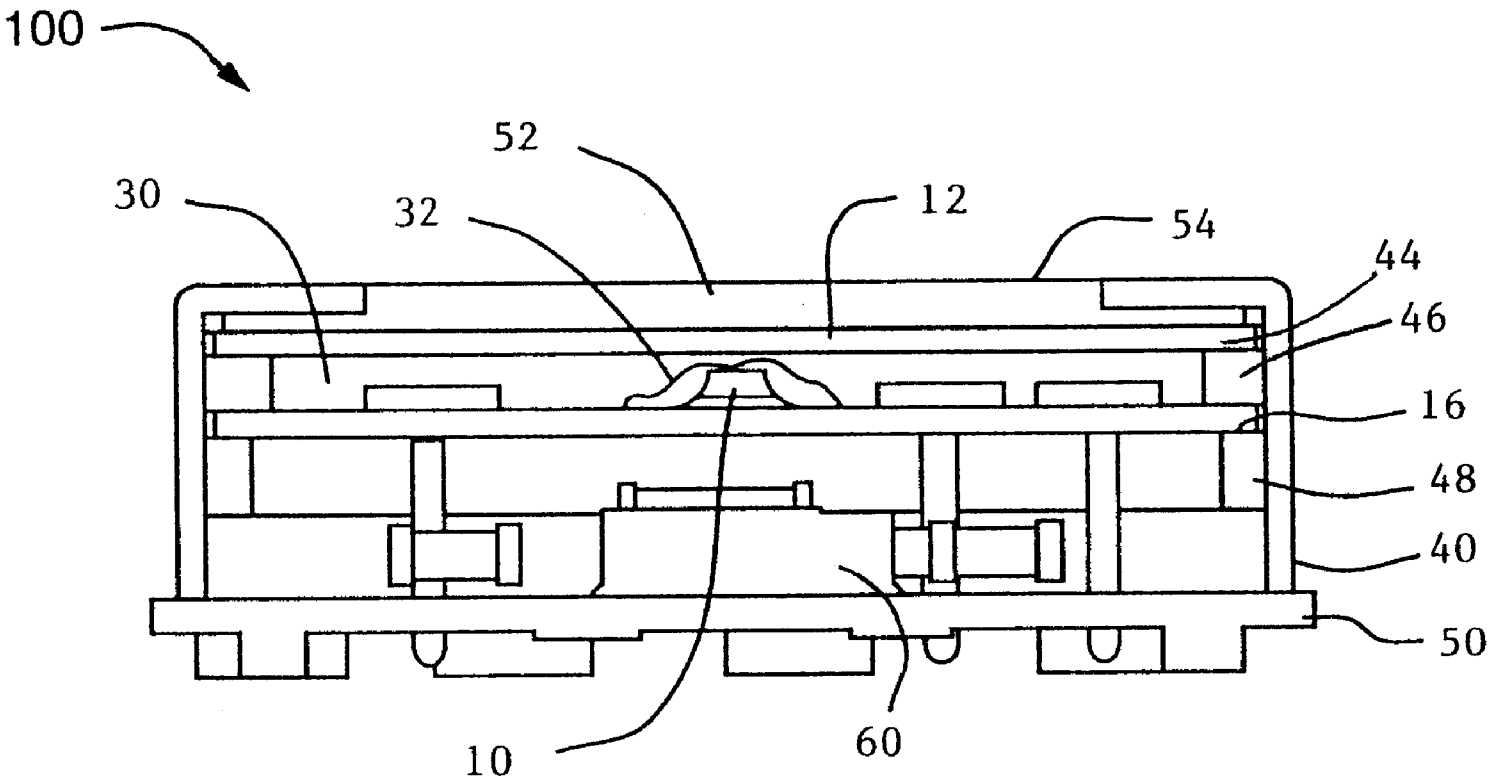
FIG. 1 is a schematic side view of a first embodiment of the invention in which a microphone assembly contains a JFET buffer with source/drain flip-chip pads and a backside gate fastened to a microphone backplate.
Figure 2:
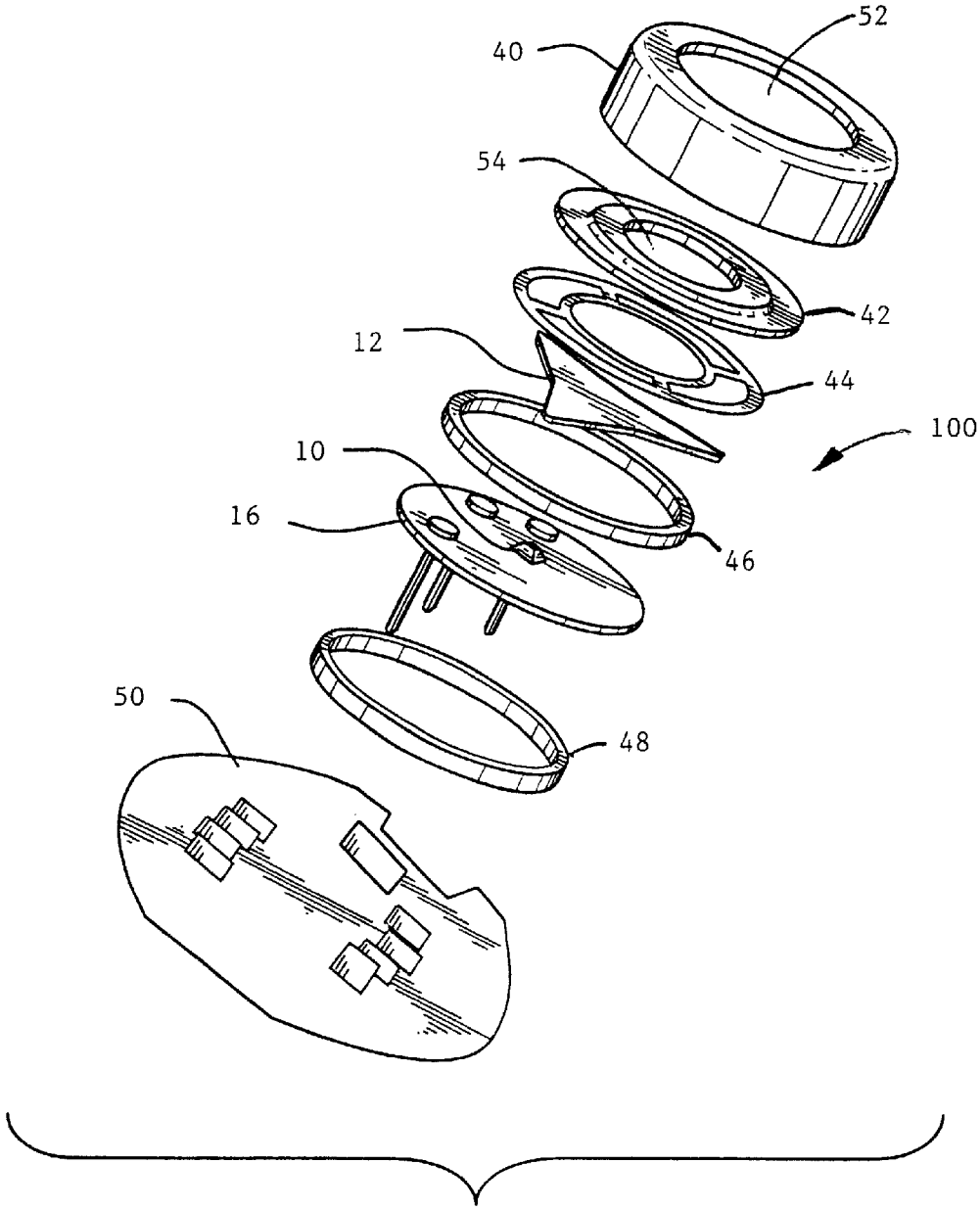
FIG. 2 is an exploded view of the assembly of FIG. 1.

FIG. 1 is a sectional view of this embodiment of the hearing aid microphone module or assembly 100 and FIG. 2 is an exploded view of the assembly 100. Assembly 100 contains all the electronic components other than the battery and a receiver necessary for a functional hearing aid. A circular metallic cover 40 is provided with a large diameter opening 52 for passage of sound from a faceplate (not shown) of a hearing aid enclosure in which the assembly 100 is adapted to be disposed proximally adjacent thereto. Sound impinges on large circular diaphragm 54 supported and attached to circular frame 42 and underlying spacer 44 which prevents the diaphragm 54 from contacting backplate 12. Backplate 12, in turn, is supported at its edges by an insulative bushing, such as, polytetrafluorethylene (PTFE) and is disposed over PCB 16 and acoustically and electrically sealed to cover 40 by a conductive cement, such as, epoxy. This partial assembly is then retained by snap ring 48 in cover 40. The electrical component PCB 50 is then attached to the cover 40 to complete the assembly.

Figure 3:
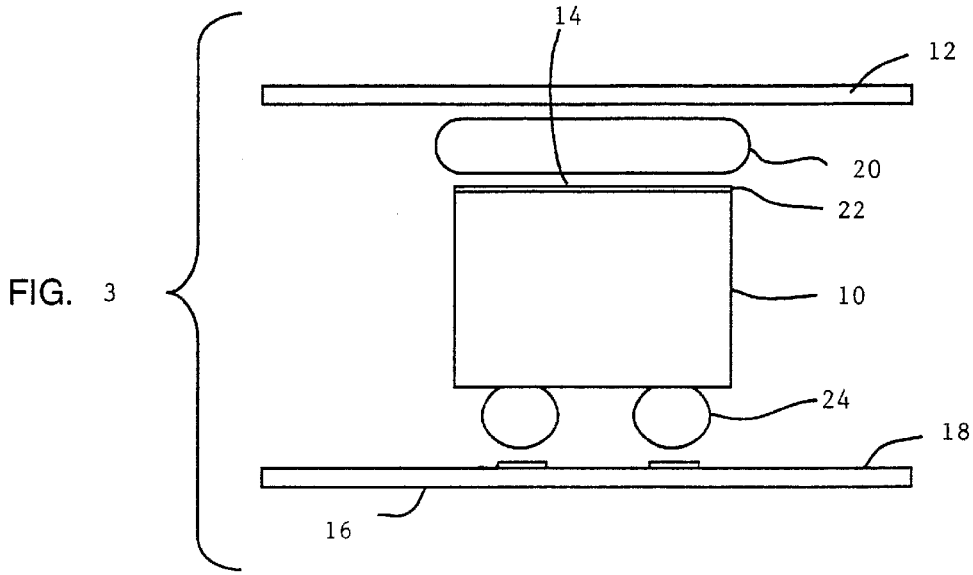
FIG. 3 is an enlarged schematic detail of the JFET buffer portion of FIG. 2 prior to assembly.
Figure 4:
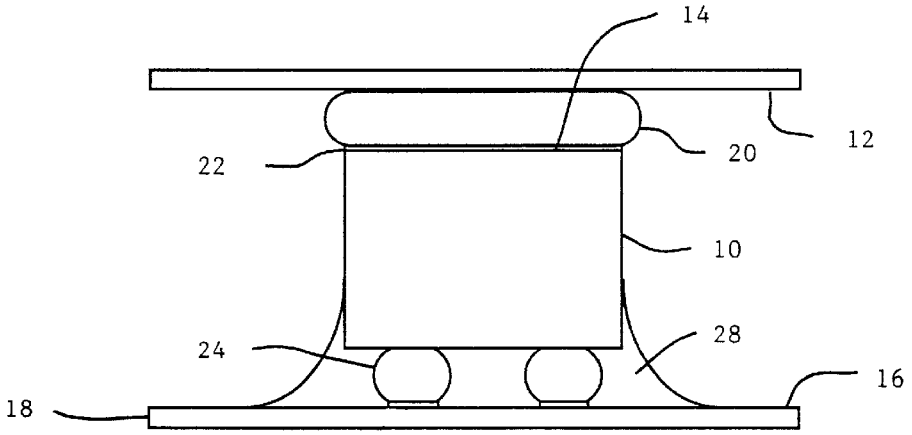
FIG. 4 is a detail as in FIG. 3 after assembly.

FIGS. 3 and 4 show details of the flip-chip JFET connections including the gate to backplate connection 14 using conductive epoxy 20. FIG. 3 is an exploded view before assembly, while FIG. 4 shows the JFET after assembly with the PCB 16 and the backplate 12. The metallization 22 on the top of the JFET die 10 is the gate connection, which is a very high impedance point. The solder bumps 24 on the bottom are the low impedance connections such as the drain and source connections. In this embodiment of the invention, four solder bumps: Drain, Source, Bias, and one dummy solder bump that is a No-Connect (NC) are provided. (NC is not connected to any part of the JFET circuit.) The underfill material 28 provides mechanical support.

This embodiment of the invention produces the following advantages:

a. A flip-chip JFET 10 with no gate contact made to the PCB, allows use of low cost FR4 or other such materials instead of ceramic for the PCB substrate.

b. By controlling the depth of the front chamber 30 in the microphone assembly so that the spacing from the backplate to the PCB substrate is small enough, a single blob of conductive (epoxy) cement 20 is sufficient to bridge the gap, eliminating the need for wire bonds.

c. Stray capacitance from the gate to PCB substrate is reduced because of this gate isolation, resulting in decreased signal loss and decreased noise pickup.

d. The use of four solder balls on JFET provides better mechanical support and alignment during assembly. (Solder bumps on Drain, Source, Bias, and NC solder bumps 752).

EQUIVALENTS

While this invention has been particularly shown and described with reference to preferred embodiments thereof, it will be understood by those skilled in the art that various changes in form, modification, variation and details may be made therein without departing from the scope of the invention as defined by the appended claims.

What is claimed is:

1. A hearing aid comprising an electret microphone formed of a metallic coated diaphragm laterally disposed at one end of a housing opposite a backplate and wherein said housing includes an inwardly extending sidewall and a front wall partly enclosing a back chamber which is acoustically sealed by a first PCB laterally extending across and contacting said sidewall at an open end of the housing, and wherein electronic components for the hearing aid are located on said first PCB and a first electrical connection is formed between said backplate and a gate terminal on a flip-chip semiconductor device on the first PCB and second and third electrical connections are made between said semiconductor device and an electrical component.

2. The hearing aid of claim 1 in which the first electrical connection is made by conductive epoxy contacting both the backplate and the gate terminal.

3. The hearing aid of claim 2 wherein the gate terminal is on a side of the device adjacent to the backplate.

4. The hearing aid of claim 3 wherein the electrical components are mounted on a second PCB.

5. The hearing aid of claim 4 wherein the first and second connections are made by leads from the JFET device extending through vias in the first PCB.

6. A hearing aid microphone assembly comprising an electret microphone formed of a metallic coated diaphragm laterally disposed at one end of a housing opposite a backplate and wherein said housing includes an inwardly extending sidewall and a front wall partly enclosing a back chamber which is acoustically sealed by a first PCB laterally extending across and contacting said sidewall at an open end of the housing, and wherein electronic components for the hearing aid are located on the first PCB and a first electrical connection is formed between said backplate and a gate terminal on a flip-chip device on the first PCB and second and third electrical connections are made between said device and an electrical component.

7. The assembly of claim 6 in which the PCB's are formed of glass epoxy.

8. The assembly of claim 7 wherein the gate terminal is on a side of the device adjacent to the backplate.

9. The assembly of claim 8 wherein the electrical component is on a second PCB.

* * * * *